US008967179B2

(12) United States Patent
Ozzello

(10) Patent No.: US 8,967,179 B2
(45) Date of Patent: Mar. 3, 2015

(54) SERVO-VALVE PILOT STAGE AND A TWO-STAGE SERVO-VALVE INCLUDING SUCH A STAGE

(75) Inventor: Guylain Ozzello, Plaisance du Touch (FR)

(73) Assignee: Zodiac Hydraulics, Societe par Actions Simplifiee, Chateaudun (FR)

( * ) Notice: Subject to any disclaimer, the term of this patent is extended or adjusted under 35 U.S.C. 154(b) by 169 days.

(21) Appl. No.: 13/812,920

(22) PCT Filed: Jul. 29, 2011

(86) PCT No.: PCT/EP2011/063153

§ 371 (c)(1),
(2), (4) Date: Apr. 11, 2013

(87) PCT Pub. No.: WO2012/013808

PCT Pub. Date: Feb. 2, 2012

(65) Prior Publication Data

US 2013/0206260 A1 Aug. 15, 2013

(30) Foreign Application Priority Data

Jul. 29, 2010 (FR) ..... 10 56269

(51) Int. Cl.
*F15B 5/00* (2006.01)
*F15B 13/042* (2006.01)
*F15B 13/043* (2006.01)

(52) U.S. Cl.
CPC ..... *F15B 13/0426* (2013.01); *F15B 13/0436* (2013.01)
USPC ..... 137/83; 137/625.61; 137/625.63

(58) Field of Classification Search
USPC ..... 137/83, 625.61, 625.63, 625.64
See application file for complete search history.

(56) References Cited

U.S. PATENT DOCUMENTS

| | | | | |
|---|---|---|---|---|
| 3,331,383 | A | 7/1967 | Buchanan | |
| 3,401,603 | A * | 9/1968 | Coakley et al. | 91/387 |
| 3,424,183 | A * | 1/1969 | Coakley | 137/83 |
| 3,584,649 | A | 6/1971 | Cobb et al. | |
| 3,621,880 | A * | 11/1971 | Jessee et al. | 137/625.64 |
| 4,201,114 | A * | 5/1980 | Cobb et al. | 91/3 |
| 5,303,727 | A * | 4/1994 | Wilson et al. | 137/83 |
| 7,726,340 | B2 * | 6/2010 | Druhan | 137/625.63 |

FOREIGN PATENT DOCUMENTS

| | | |
|---|---|---|
| DE | 12 06 602 B | 12/1965 |
| FR | 1 031 716 A | 6/1953 |
| FR | 2 052 512 A5 | 4/1971 |

OTHER PUBLICATIONS

International Search Report for PCT/EP2011/063153 dated Nov. 22, 2011.

* cited by examiner

*Primary Examiner* — Craig Schneider
*Assistant Examiner* — R. K. Arundale
(74) *Attorney, Agent, or Firm* — Sughrue Mion, PLLC

(57) ABSTRACT

A pilot stage for a jet type servo-valve, the pilot stage including an ejector for ejecting a jet of fluid and that is movable facing a deflector suitable for generating a pressure difference that can be used for moving a spool of the servo-valve. The ejector extends radially projecting from a column to which the ejector is secured and is in fluid-flow communication with a central bore of the column through which the ejector is fed with fluid, the column having a first end that is embedded in the servo-valve and through which the fluid is introduced into the column, and the column has a second end that is subjected to drive from a torque motor for selectively twisting the column in one direction or the other about a rest position.

11 Claims, 4 Drawing Sheets

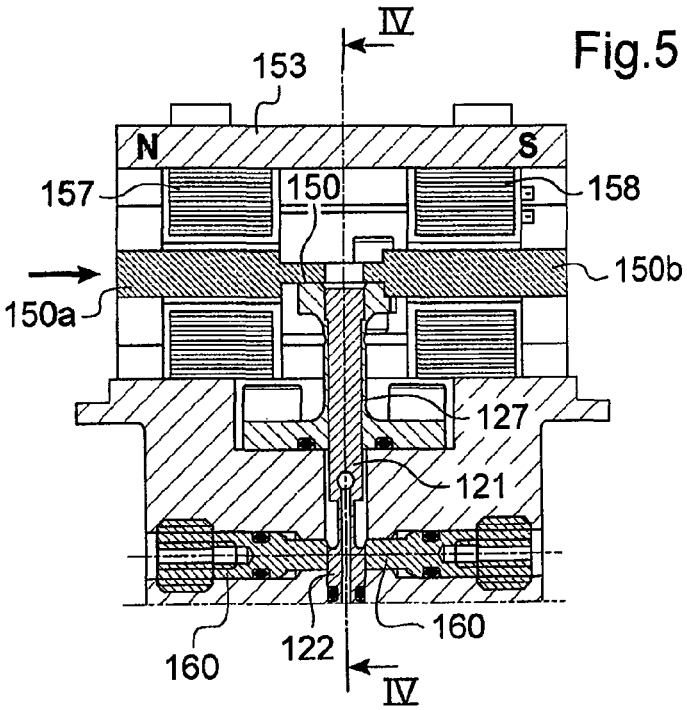
Fig.5
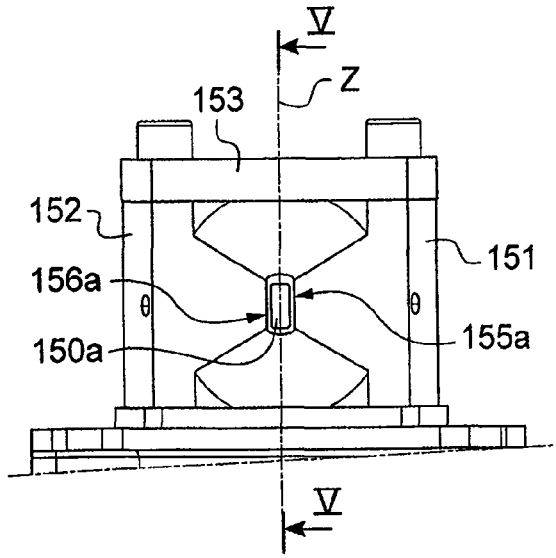
Fig.6
Fig.7
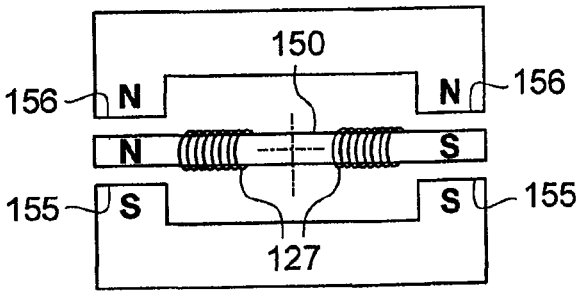

SERVO-VALVE PILOT STAGE AND A TWO-STAGE SERVO-VALVE INCLUDING SUCH A STAGE

CROSS REFERENCE TO RELATED APPLICATIONS

This is a National Stage of International Application No. PCT/EP2011/063153 filed Jul. 29, 2011, claiming priority based on French Patent Application No. 10 56269 filed Jul. 29, 2010, the contents of all of which are incorporated herein by reference in their entirety.

The invention relates to a servo-valve pilot stage suitable for acting as a first stage in a two-stage servo-valve. The invention also provides a two-stage servo-valve including a pilot stage of the above-specified type.

TECHNOLOGICAL BACKGROUND OF THE INVENTION

Jet servo-valves are well known. It is known that they are better at withstanding pollution of the fluid because the distance between the ejector and the deflector is greater than the distance between a nozzle and the flapper.

The pilot stage of a jet servo-valve has an ejector for ejecting a jet of fluid towards a receiver, such as deflector or an orifice. The ejector and the receiver are movable relative to each other. The relative movement between the receiver and the jet leaving the ejector enables the receiver to create pressure differences that are used for obtaining fine control over the movement of the spool of the distribution stage of the servo-valve.

Nevertheless, a known drawback of servo-valves with a jet pilot stage is the need to channel the fluid to the ejector by passing over the moving assembly of the servo-valve. Global standard SAE ARP490E requires servo-valves to be fastened and fed with hydraulic fluid via their bottom faces.

OBJECT OF THE INVENTION

An object of the invention is to provide a pilot stage having a movable ejector that is simpler than known stages.

BRIEF SUMMARY OF THE INVENTION

In order to achieve this object, the invention provides a pilot stage for a jet type servo-valve, the pilot stage comprising an ejector for ejecting a jet of fluid and that is movable facing a deflector suitable for generating a pressure difference that can be used for moving a spool of the servo-valve, and wherein the ejector extends radially projecting from a column, the column has a first end that is embedded in the servo-valve and through which the fluid is introduced into the column, and the column has a second end that is subjected to drive from a torque motor for selectively twisting the column in one direction or the other about a rest position. According to the invention, the column is a single piece and the ejector is fastened at the end of a tube that extends radially from the column while being in fluid-flow communication with a central bore of the column through which the ejector is fed with fluid.

The pilot stage of the invention thus makes use of a member that is deformable in twisting in order to move the ejector by acting directly on the deformable member that carries the ejector by means of a torque motor that acts in constant manner on the column regardless of the angle through which the column has twisted, while maintaining a high degree of proportionality between the action of the motor and the movement of the ejector, thereby making it possible to achieve fine control over the angular position of the ejector. Furthermore, the embedded end may be implanted in a low portion of the servo-valve, thereby eliminating the need to cause an ejector feed duct to pass over the distribution assembly.

A central location for the column contributes to obtaining a balanced design for the servo-valve that can improve its ability to withstand vibration and that can also improve its dynamic response. Designing the twistable column as a single piece reduces the number of moving parts and the number of seals that need to be made between them. The invention also provides a servo-valve including such a pilot stage.

BRIEF DESCRIPTION OF THE FIGURES

The invention can be better understood in the light of the following description of a particular embodiment of the invention, given with reference to the following figures:

FIG. 5 is a section view on line V-V of FIG. 6;

FIG. 6 is a fragmentary side view of the servo-valve of FIGS. 2 to 5;

FIG. 7 is a diagram showing the respective polarizations of the flapper and of the stator of the servo-valve.

DETAILED DESCRIPTION OF THE FIGURES

Figure 1:
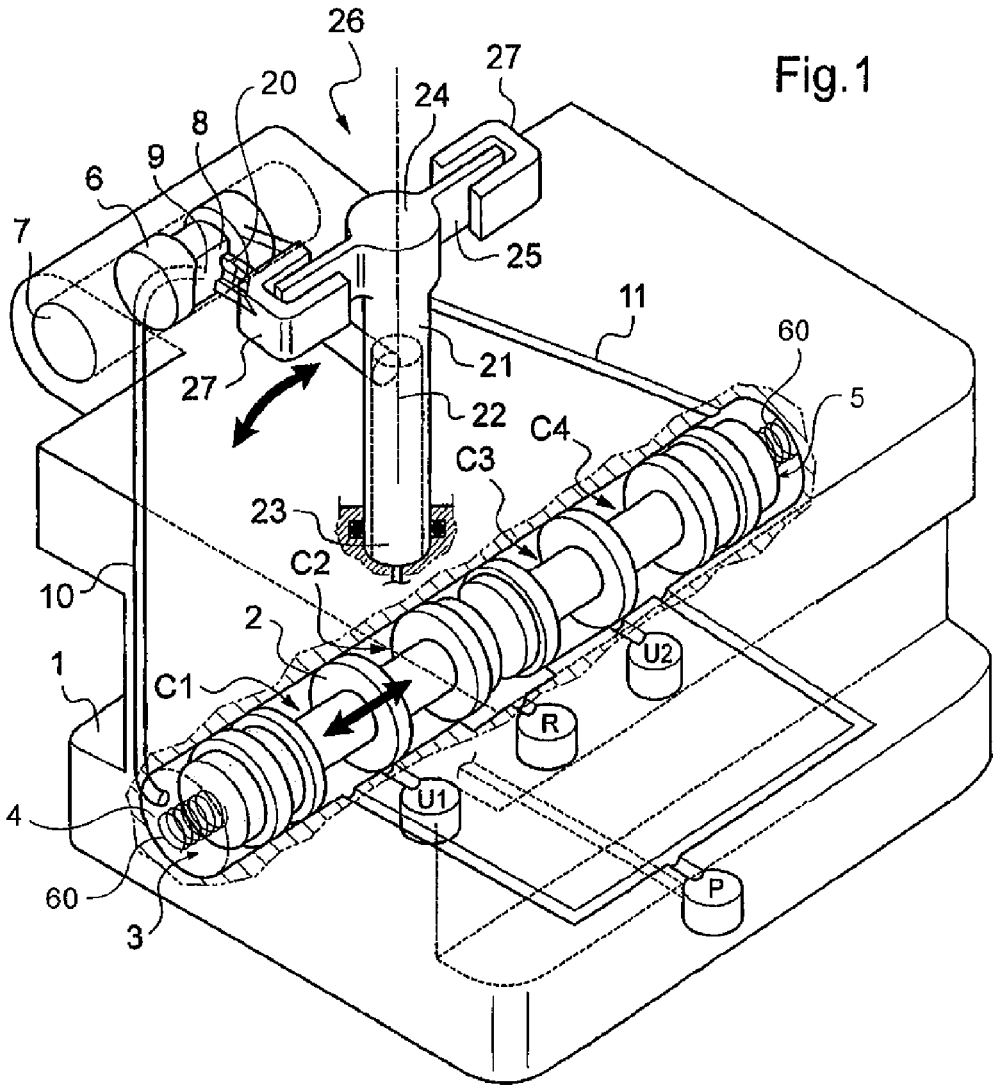
FIG. 1 is a diagram of the invention as applied to a two-stage servo-valve in a first particular embodiment of the invention, the torque motor being omitted.

With reference to FIG. 1, the invention is shown in application to a servo-valve with barometric flowrate-regulation and two stages including a pilot stage. Naturally, the invention is not limited to this application and it may be used with other types of servo-valve.

The servo-valve shown comprises a body 1 in which a spool 2 is mounted to slide in leaktight manner in a cylindrical bore 3 by forming the distribution stage. The servo-valve rests on a machined bearing face 1000 having a port P for feeding the servo-valve with fluid, two utilization ports U1 and U2, and a return port R. These ports are in fluid-flow communication with corresponding ports of the support on which the servo-valve is fastened. The spool 2 is movable between two extreme positions and it is shaped to define leaktight chambers C1, C2, C3, and C4 inside the bore 3 respectively for use, depending on the extreme position of the spool 2 relative to a central position (or neutral position), for putting:

- either the feed port P into communication with a first utilization port U1, and a return port R with a second utilization port U2;
- or else the feed port P into communication with the second utilization port U2, the return port R being in communication with the first utilization port U1. The sliding of the spool 2 in the bore 3 is controlled by pilot chambers 4 and 5 that are fed with fluid under pressure by a pressure-sharing member, specifically in this example a deflector 6 engaged in leaktight manner in a housing 7 of the body 1. The deflector 6 has a central flat 8 in which a sharing orifice 9 is formed. The sharing orifice 9 is put into communication via ducts 10 and 11 with the pilot chambers 4 and 5. Springs 60 are provided to exert forces reacting against the pilot pressures induced on the spool 2 in order to enable its position to be servo-controlled.

Facing the central flat 8 there is an ejector 20 that ejects a jet of fluid towards the sharing orifice 9. The ejector 20 is movable facing the sharing orifice 9 so as to move the point of impact of the jet on the central flat 8, thereby having the effect of varying the pressures that exist in the pilot chambers 4 and 5, thus enabling the spool to be moved in response to the movement of the ejector 20. The above is well known and is recalled merely to situate the context of the invention.

According to an essential aspect of the invention, the ejector 20 is secured to a one-piece column 21 that is twistable and has a tube fastened to its end, which tube extends radially therefrom, and is in fluid-flow communication with a central bore 22 of the column, through which the ejector 20 is fed with fluid. The column 21 has a first end 23 that is fastened in leaktight manner in the body 1 in a direction that is substantially perpendicular to the bearing face 1000 and through which the fluid is introduced into the central bore of the column, the fluid coming from the feed port P (the feed duct is drawn in dashed lines and may be drilled directly in the body 1). The first end of the column may be implanted in a low portion of the body 1, close to the pressure feed, thereby avoiding any need to pass feed ducts for the ejector 20 over the distribution assembly.

The column 21 has a second end 24 that is secured to the rotor 25 of a torque motor 26 having its stator 27 fastened on the body 1.

Thus, when the torque motor 26 is powered, it twists the column 21 about its axis Z, thereby causing the ejector 20 to move angularly facing the sharing orifice 9 so that the impact of the jet produced by the ejector 20 moves relative to the sharing orifice 9.

The movement of the point of impact of the jet is small and may be considered to be a movement in translation along the tangent to the trajectory of the ejector 20. A high degree of proportionality is conserved between this movement and the torque that is imposed by the torque motor 26 on the column, and thus with the electric current fed thereto.

When the torque motor 26 is unpowered, the column 21 is at rest, and the jet produced by the ejector 20 impacts the central flat 8 of the deflector at a location for which the pressures in the pilot chambers 4 and 5 are in equilibrium. For this purpose, the deflector 6 is provided with adjustment means enabling its precise positioning in the housing 9 facing the ejector to be adjusted.

Figure 2:
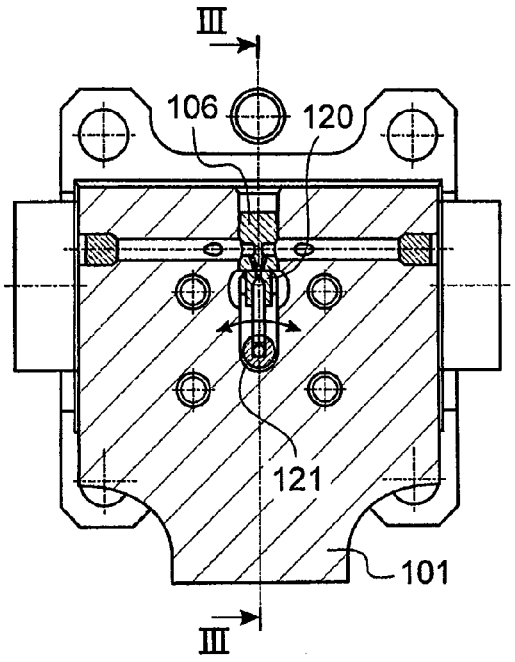
FIG. 2 is a section view on line II-II of FIG. 3 showing a servo-valve in a second particular embodiment of the invention.

With reference below to the second particular embodiment shown in FIGS. 2 and 3, in which the references for elements that are common with those of FIG. 1 are the same plus one hundred, the servo-valve comprises, as above, a body 101 in which a spool 102 is slidably mounted. The pilot stage has a deflector 106 and an ejector 120 that is secured to a column 121 by being mounted at the end of a tube 130 that extends radially from the column 121. The column 121 has a first end that is embedded in leaktight manner in the body 101, and a second end 124 that is subjected to the action of a torque motor 126. The column 121 has a central bore 122 enabling the ejector 120 and the feed port P to be put into fluid-flow communication by the first end 123 via the central bore 122 and the tube 130. It can be seen in this embodiment that the embedded end of the column is likewise implanted close to the pressure feed of the servo-valve.

Figure 3:
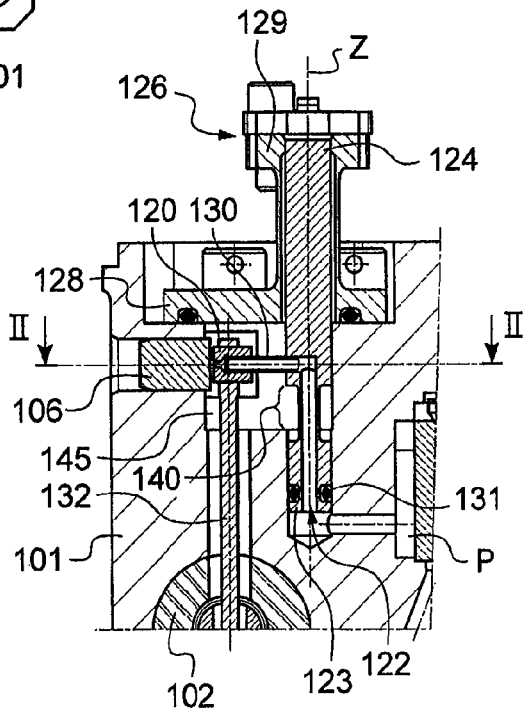
FIG. 3 is a section view on line III-III of FIG. 2.

As can be seen more particularly in FIG. 3, the column 121 has a twistable section 140 of small thickness, with the remainder of the column being, in comparison, very stiff in twisting. The twisting stiffness of the column 121 thus depends essentially on the thickness, on the diameter, and on the length of this twistable section. This makes it simple to adapt the twisting stiffness of the column 121 by acting on these manufacturing parameters. It should be observed that it is ensured that the twistable section extends over a fraction of the length of the central bore 122, thus making it possible to achieve stiffness that is small compared with the stiffness of the column 121 (being about 20%), thereby increasing the angle through which the injector can move relative to the angular movement of the flapper 150.

It is advantageous to obtain stiffness that is relatively small, thus making it possible for a required angular stroke of the deflector 120 to make use of a torque motor of smaller power. Thus, the torque to be withstood by the embedded end is made smaller and this may be guaranteed merely by the first end 123 of the column 121 being a tight fit in its housing. Sealing is then guaranteed by a simple static gasket 131.

In this embodiment and according to a particular aspect of the invention, the column 121 is surrounded by a thin-walled tube 127 that extends from a soleplate 128 that is fastened in leaktight manner to the body of the servo-valve to a flange 129 tightly surrounding the end 124 of the column. The flange 129 and said end are fastened together so that during twisting driven by the torque motor 126, the thin-walled tube 127 and the twistable portion 140 work in parallel and are subjected to the twisting. These two parts serve to seal the chamber 145 into which the ejector 120 ejects the fluid, without having recourse to a sealing gasket rubbing against the end of the column that co-operates with the torque motor, which could give rise to hysteresis.

In another particular aspect of the invention, the resilient return force between the spool 102 and the ejector 120 that is secured to the column 121 is provided in this embodiment by a flexible rod 132 connected at one of its ends to the column 121 and extending as far as the spool 102. The rod 132 extends parallel to the column 121.

Figure 8:
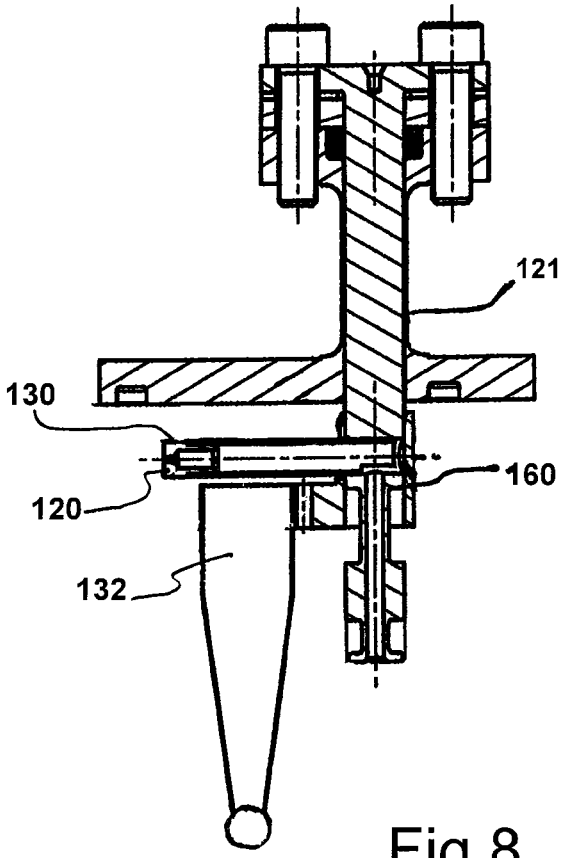
FIG. 8 is a view of the pilot stage of the servo-valve in a third embodiment.

In another particular embodiment that is shown in FIG. 8, the return-force rod 132 is secured to the column 121. Ideally it is in the form of a flexible blade 132 that is generally triangular in shape. The base of the triangle is radially connected to the column 121, with the vertex opposite from that side being in connection with the spool 102. In this embodiment, the rod 132 is connected to the column 121 by a bushing 160 shrink-fitted on the column 121. This bushing 160 carries the rod 132 and extends beyond the tube 130. A longitudinal notch allows the tube 130 to be engaged in the bushing 160, so as to provide the mechanical connection between the flexible blade 132 and the ejector 120.

Figure 4:
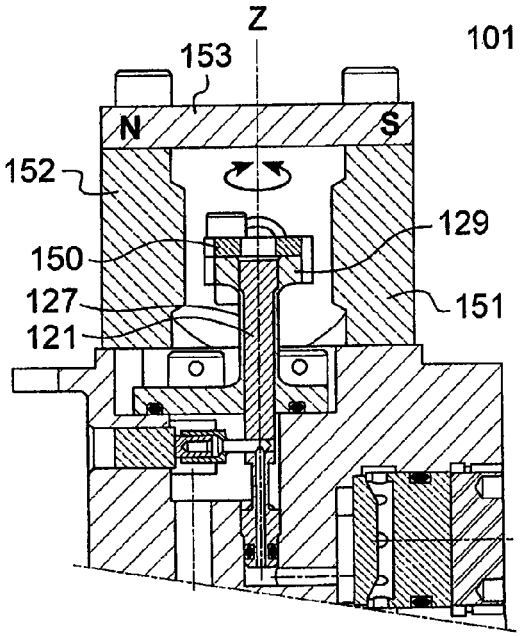
FIG. 4 is a view analogous to the view of FIG. 3, the torque motor being shown.

The torque motor 126 is described in detail below with reference to FIGS. 4 to 6. It comprises a flapper 150 having two opposite arms **150*a* and 150*b* and that is connected to the flange 129 by screw-fastening. The flapper 150 is surrounded by a ferromagnetic structure having two flanks 151 and 152 that are connected together in their top portions by a permanent magnet 153 that is north-south biased as shown in FIG. 4**.

As can be seen in FIG. 6, the flanks 151 and 152 present active faces 155 and 156 that are arranged immediately facing the faces of the flapper 150, leaving only a small airgap, with this being on either side of the twist axis Z. The permanent magnet 153 thus generates magnetic fluxes that pass via the active faces 155, 156, with each of them looping via one of the arms of the flapper 150 on either side of the axis. Since the fluxes are equal, the flapper is not subjected to any torque.

Coils 157 and 158, each arranged to surround one of the arms of the flapper 150, are powered in opposition, thereby producing torque on the flapper 150 that is proportional to the product of the currents fed to the coils 157 multiplied by the number of turns in the coils so as to generate a magnetic flux within the flapper that produces a north polarization on the portion 150*a* and a south polarization on the portion 150*b* (see FIG. 7). This serves to establish a torque on the flapper 150 that serves to twist the column 121 and the tube 127.

Naturally, this twisting is very small, being of the order of a few tenths of a degree. It suffices to reverse the direction of the current fed to the coils in order to reverse the direction of the twisting.

It should be observed that in the variant shown in FIG. 5, the base 122 of the column 121 is embedded not by means of a tight fit, but by means of at least one clamping screw, and specifically in this example two clamping screws 160.

Naturally, the invention is not limited to the above description, but covers any variant coming within the ambit defined by the claims.

In particular, although the above-described column is mounted parallel with a twistable thin-walled tube, such a configuration could be avoided if sealing can be ensured for the chamber into which the ejector sends fluid. In particular, it is possible to use a bellows, or a gasket that is capable of deforming in twisting without sliding and without friction and that does not present hysteresis.

The two stages of the servo-valve may constitute a single module or they may be in the form of separate modules enabling servo-valves to be constructed in modular manner.

What is claimed is:

1. A pilot stage for a jet type servo-valve, the pilot stage comprising an ejector for ejecting a jet of fluid and that is movable facing a deflector suitable for generating a pressure difference that can be used for moving a spool of the servo-valve, and wherein the ejector extends radially projecting from a column, the column has a first end that is embedded in the servo-valve and through which the fluid is introduced into the column, and the column has a second end that is subjected to drive from a torque motor for selectively twisting the column in one direction or the other about a rest position, wherein the column is a single piece, the ejector being fastened at an end of a tube that extends radially from the column and being in fluid-flow communication with a central bore of the column through which the ejector is fed with fluid.

2. A pilot stage according to claim 1, wherein the column has a twistable portion of twisting stiffness that is small relative to the remainder of the column, the twistable portion extending along a length from the central bore of the column.

3. A pilot stage according to claim 1, wherein the embedded end is held stationary by means of a tight fit between said embedded end and a housing for receiving said embedded end.

4. A pilot stage according to claim 1, wherein the embedded end is held stationary by means of at least one clamping screw for clamping said embedded end.

5. A pilot stage according to claim 3, wherein said end is sealed in the housing by a static gasket.

6. A pilot stage according to claim 1, wherein the embedded end of the column is located in the proximity of a pressure feed of the servo-valve.

7. A pilot stage according to claim 1, wherein the second end is embedded in a terminal flange of a thin-walled tube surrounding the column, the tube being secured to a soleplate for closing in leaktight manner a chamber into which the ejector ejects the fluid.

8. A pilot stage according to claim 1, wherein the torque motor has a flapper with two opposite arms that are subjected to the electromagnetic action of a permanent magnet, the torque motor having two coils, each surrounding a respective arm of the flapper and fed in opposition in order to generate opposite polarizations of the arms of the flapper so as to create a torque on the flapper.

9. A pilot stage according to claim 1, wherein a return force rod is connected to the column.

10. A two-stage servo-valve including a pilot stage in accordance with claim 1.

11. A pilot stage according to claim 4, wherein said embedded end is sealed in the housing by a static gasket.

* * * * *